United States Patent [19]

Maeda et al.

[11] Patent Number: 4,619,523

[45] Date of Patent: Oct. 28, 1986

[54] TONER CLEANING APPARATUS IN ELECTROPHOTOGRAPHY

[75] Inventors: Masahiko Maeda, Izumiotsu; Toru Nakazawa, Kumatori; Yasuharu Utsunomiya, Nara; Ryuji Wataki, Sakai, all of Japan

[73] Assignee: Mita Industrial Co., Ltd., Osaka, Japan

[21] Appl. No.: 634,466

[22] Filed: Jul. 25, 1984

[30] Foreign Application Priority Data

Jul. 27, 1983 [JP] Japan ..... 58-135898

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,660,863 | 5/1972 | Gerbasi | 15/256.51 |
| 3,859,691 | 1/1975 | Katayama et al. | 15/256.51 |
| 4,026,648 | 5/1977 | Takahashi | 355/15 |
| 4,145,137 | 3/1979 | Sunaga et al. | 355/15 |
| 4,165,173 | 8/1979 | Iwai et al. | 355/15 |
| 4,451,140 | 5/1984 | Saito | 355/15 |

*Primary Examiner*—Fred L. Braun

*Attorney, Agent, or Firm*—Sherman and Shalloway

[57] ABSTRACT

A toner cleaning apparatus for removing a toner left on the surface of an electrophotographic photosensitive material by a doctor blade in the electrophotographic process includes an elastic doctor blade having a toner-scraping top end, a holder for supporting the base of the doctor blade, a fulcrum for swingably supporting the holder and a pressing mechanism for pressing the top end of the doctor blade to the surface of the photosensitive material, wherein the fulcrum and doctor blade are arranged so that on the feed-out side of the photosensitive material, the contact angle $\alpha$ between the top end of the doctor blade and the photosensitive material is smaller than the angle $\beta$ between the photosensitive material and the line connecting the top end of the doctor blade to the fulcrum, and the pressing mechanism and doctor blade are arranged in such an elastic engagement relation that as the applied stress is increases, the top end of the doctor blade is retreated to the feed-out side and the degree of flexion of the doctor blade is increased.

5 Claims, 3 Drawing Figures

TONER CLEANING APPARATUS IN ELECTROPHOTOGRAPHY

BACKGROUND OF THE INVENTION (1) Field of the Invention:

The present invention relates to a toner cleaning apparatus in electrophotography. More particularly, the invention relates to an apparatus for effectively peeling and removing a residual toner from the surface of a photosensitive material by using an elastic doctor blade while preventing abrasion of the surface of the Photosensitive material.

(2) Description of the Prior Art:

Referring to FIG. 1, in the electrophotographic process, the surface of a photoconductive photosensitive material 1 is charged by a charger 11 and is exposed imagewise to light through an optical system 12 to form an electrostatic latent image. This electrostatic latent image is developed with a toner 14 by a developing mechanism 13, and the formed toner image is electrostatically separated and transferred to a transfer sheet 15 by a charger 16. After the transfer, the toner left on the surface of the photosensitive material is removed by a cleaning mechanism 2, if necessary after removal of electricity by a charger 17. The reproduction is carried out by repeating the foregoing operations. The toner left on the surface of the photosensitive material after the transfer step is electrostatically attracted to the surface of the photosensitive material, and removal of this residual toner by cleaning is not always easy.

Cleaning of toners has heretofore been performed by a method using a fur brush, a method using an elastic blade or a method using a magnetic brush. The fur brush method involves a problem of scattering of the toner and the magnetic brush method is defective in that an expensive magnet-containing cleaning sleeve should be independently disposed. Furthermore, in the case where the developing sleeve is used also for the cleaning operation, the reproduction cycle is prolonged because of the cleaning operation. The method for effecting cleaning by sliding contact of the surface of the photosensitive material with the elastic blade is advantageous in that the mechanism and operation are simple. However, in order to remove toner particles from the surface of the photosensitive material against the electrostatic attracting force to the surface of the photosensitive material, a considerably great pressing or contacting force should be imposed on the top end of the blade, resulting in scratching of the surface of the photosensitive material or shortening of the life of the photosensitive material.

SUMMARY OF THE INVENTION

It is therefore a primary object of the present invention to provide a cleaning apparatus for cleaning a residual toner from the surface of a photosensitive material by using an elastic doctor blade, wherein cleaning of the toner from the surface of the photosensitive material can be effectively performed while controlling abrasion or scratching of the surface of the photosensitive material.

Another object of the present invention is to provide a cleaning apparatus in which the degree of pressing or flexion is automatically adjusted within a range suitable for peeling and removal of a toner according to the degree of adhesion of the residual toner to the surface of a photosensitive material.

In accordance with the present invention, there is provided a toner cleaning apparatus for removing a toner left on the surface of an electrophotographic photosensitive material by a doctor blade in the electrophotographic process, which comprises an elastic doctor blade having a toner-scaping top end, a holder for supporting the base of the doctor blade, a fulcrum for swingably supporting said holder and a pressing mechanism for pressing the top end of the doctor blade to the surface of the photosensitive material, wherein the fulcrum and doctor blade are arranged so that on the feed-out side of the photosensitive material, the contact angle $\alpha$ between the top end of the doctor blade and the photosensitive material is smaller than the angle $\beta$ between the photosensitive material and the line connecting the top end of the doctor blade to the fulcrum, and the pressing mechanism and doctor blade are arranged in such an elastic engagement relation that as the applied stress is increased, the top end of the doctor blade is retreated to the feed-out side and the degree of flexion of the doctor blade is increased.

DETAILED DESCRIPTION OF THE INVENTION

The present invention will now be described in detail with reference to the accompanying drawings.

Figure 1:
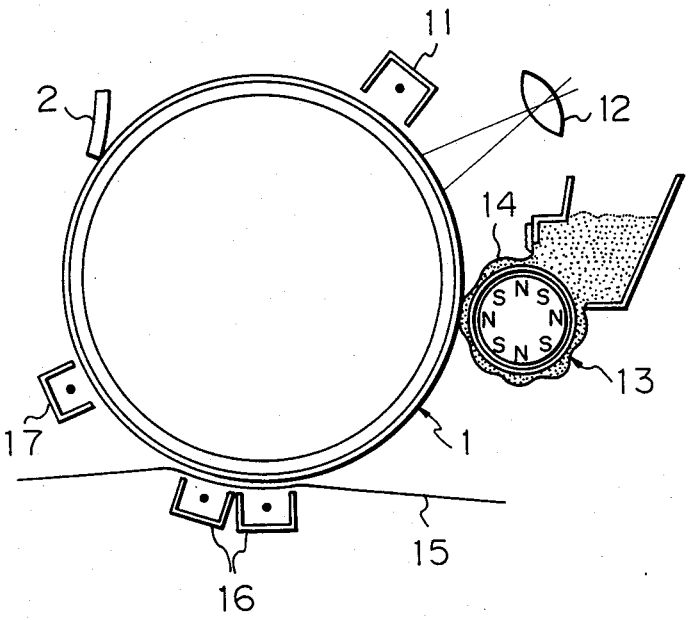
Fig. 1 PRIOR ART
FIG. 1 is a schematic arrangement diagram showing an electrophotographic copying apparatus to which the cleaning apparauts of the present invention is attached.
Figure 2:
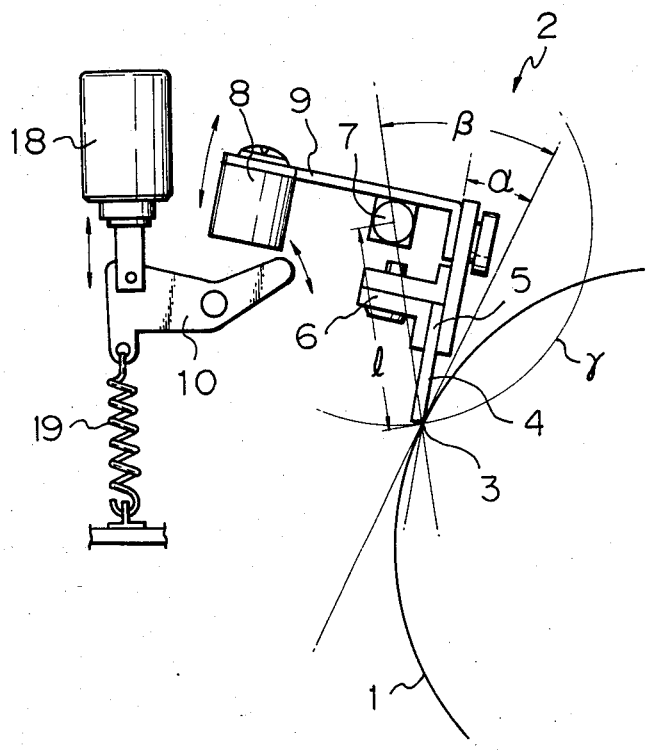
FIG. 2 is a diagram illustrating the cleaning apparatus of the present invention.

Referring to FIG. 2 showing the structure of the cleaning apparatus 2 of the present invention, this apparatus 2 comprises an elastic doctor blade 4 having a toner-scraping top end 3, a holder 6 for supporting a base 5 of the doctor blade 4, a fulcrum 7 for swingably supporting the holder 6 and a pressing mechanism 8 for pressing the top end 3 of the blade 4 to the surface of a photosensitive drum 1.

The fulcrum 7 is arranged on the side opposite to the drum 1 with respect to the doctor blade 4, and the fulcrum 7 and doctor blade 4 are arranged so that the angle $\alpha$ between the top end 3 of the blade 4 and the surface of the drum 1 is smaller than the angle $\beta$ between the photosensitive drum 1 and the line connecting the top end 3 to the fulcrum 7.

In this embodiment, the pressing mechanism 8 is a weight hung on a lever 9 which is extended in the direction opposite to the holder 6 with respect to the fulcrum 7 and secured to the holder 6. Such a positional relationship is established that supposing that the distance between the fulcrum 7 and the top end 3 of the doctor blade 4 is l, the circle r having a radius of l crosses the circumference of the drum 1. Accordingly, the holder 6 is rotated in a counterclockwise direction in the drawings by the load imposed on the weight 8 and the top end 3 of the blade 4 is pressed to the surface of the drum 1. In this embodiment, a releasing mechanism is provided and includes a rotatable support 10 arranged below the weight 8, and a solenoid 18 and a spring 19 connected to the support 10. If this solenoid 18 is excited, the support 10 is rotated to a lower position against the pulling force of the spring 19 to set the weight 8 free, and if the solenoid 18 is de-energized, the support 10 is rotated to an upper position by the spring 19 and the weight 8 is supported by the support 10. As the result, the holder 6 is rotated in the clockwise direction to release the engagement between the top end 3 of the doctor blade 4 and the photosensitive drum 1.

It is one of the important features of the cleaning apparatus of the present invention that the pressing mechanism 8 and doctor blade 4 are arranged in such an elastic engagement relation that as the stress imposed on the blade 4 is increased, the top end 3 of the blade 4 is retreated toward the feed-out side and the degree of flexion of the blade 4 is increased.

Figure 3:
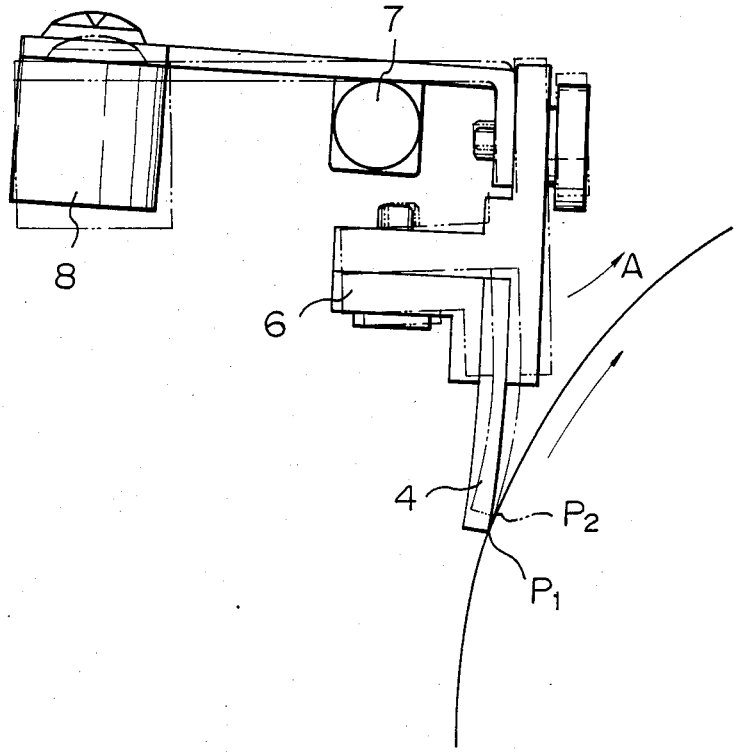
FIG. 3 is a diagram illustrating the elastic engagement relation in the cleaning apparatus of the present invention.

Referring to FIG. 3 illustrating this relation, as indicated by a solid line, the blade 4 is lightly engaged with the photosensitive drum 1 at a position P1 in the normal state, and according to the moment with the fulcrum 7 being as the center and the degree of flexion of the elastic blade 4, the pressing force or contacting force on the residual toner to the surface of the photosensitive material is changed, and by this pressing force or contacting force, the toner is peeled and removed.

If there is a residual toner adhering strongly to the surface of the photosensitive drum 1, a large stress is generated on the top end 3 of the blade 4, and with increase of this stress, the holder 6 is rotated in the direction of arrow A so as to allow the top end 3 of the blade 4 to retreat to the position P2 as indicated by an imaginary line in FIG. 3. In this case, as pointed out hereinbefore, the circle r with the fulcrum 7 being as center having a radius of l crosses the circumference of the drum 1. Accordingly, the top end 3 of the blade 4 is bent by a distance corresponding to the length of the overlapped portion of the two circumferences and is pressed or contacted strongly to the drum 1, and with increase of this pressing or contacting force, the residual toner is peeled from the drum 1.

In this case, since the top end of the blade imposes a peeling force on the strongly adhering residual toner while retreating, there is no risk of giving a shock to the surface of the photosensitive material, and furthermore, since the degree of flexion of the blade is increased and the contact angle of the top end of the blade is decreased, peeling of the residual toner is peeled more effectively. After removal of the strongly adhering toner, the top end of the blade is returned to the original position P1 and the normal cleaning operation is carried out. From the foregoing description, it will readily be understood that according to the present invention, the residual toner can be removed from the surface of the photosensitive material while minimizing the possibility of occurrence of abrasion or scratching of the surface of the photosensitive material.

In the present invention, in order to effectively remove the residual toner while preventing abrasion of the photosensitive material, it is preferred that the contact angle $\alpha$ between the top end of the doctor blade and the photosensitive material be 10° to 35°, especially 20° to 25°.In order to allow escape of the top end of the blade and adjust flexion of the blade within an appropriate range, it is preferred that the angle $\beta$ between the photosensitive material and the line connecting the fulcrum to the top end of the blade be 25° to 45°, especially 30° to 40°.

A synthetic rubber such as a urethane rubber, a silicone rubber, a fluorine resin type rubber, NBR or SBR is used for the elastic doctor blade. A blade having a thickness of 1.8 of 4 mm and a length of 4 to 16 mm is preferably used. In order to adjust the degree of flexion within an appropriate range, it is preferred that the hardness of the blade be 60 to 80.

We claim:

1. A toner cleaning apparatus for removing a toner left on the surface of an electrophotographic photosensitive material by a doctor blade in the electro-photographic process, which comprises an elastic doctor blade having a toner-scraping top end, a holder for supporting the base of the doctor blade, a fulcrum for pivotably supporting said holder and a pressing mechanism for pressing the top end of the doctor blade to the surface of the photosensitive material, wherein the pressing mechanism comprises a weight and wherein the doctor blade is located on the same side as the photosensitive material with respect to the fulcrum, and the weight, is located on the side opposite to the photosensitive material with respect to the fulcrum, the fulcrum and doctor blade are arranged so that on the feed-out side of the photosensitive material, the contact angle $\alpha$ between the top end of the doctor blade and the photosensitive material is smaller than the angle $\beta$ between the photosensitive material and the line connecting the top end of the doctor blade to the fulcrum, the pressing mechanism and doctor blade are arranged in such an elastic engagement relation that as the applied stress is increased, the top end of the doctor blade is retreated to the feed-out side and the degree of flexion of the doctor blade is increased, said angle $\alpha$ is from 10° to 35° and said angle $\beta$ is from 25° to 45°.

2. A toner cleaning apparatus as set forth in claim 1, wherein the blade has a thickness of 1.8 to 4 mm and a length of 4 to 16 mm.

3. A toner cleaning apparatus as set forth in claim 1, wherein the hardness of the blade is 60 to 80.

4. A toner cleaning apparatus set forth in claim 1, wherein the toner cleaning apparatus further comprises a releasing mechanism for releasably supporting said weight, said mechanism including a rotatable support which is arranged below said weight, and a solenoid and a spring connected to the support for enabling the support to move into and out of supporting engagement with said weight.

5. A toner cleaning apparatus as set forth in claim 4, wherein when the solenoid is de-energized, the support is rotated to an upper position by the spring and the weight is supported by the support whereby the holder is rotated to release the engagement between the top end of the doctor blade and the photosensitive material.

* * * * *